United States Patent [19]

Walters

[11] Patent Number: 5,036,627

[45] Date of Patent: Aug. 6, 1991

[54] DUSTLESS SANDING DEVICE

[76] Inventor: David Walters, 534 Cherry Rd., Gahanna, Ohio 43230

[21] Appl. No.: 372,313

[22] Filed: Jun. 28, 1989

[51] Int. Cl.[5] ..... B24B 23/00; B24B 55/10

[52] U.S. Cl. ..... 51/180; 51/273; 51/392

[58] Field of Search ..... 51/180, 175, 174, 170 TL, 51/273, 170 MT, 392

[56] References Cited

U.S. PATENT DOCUMENTS

| | | | |
|---|---|---|---|
| 3,483,662 | 12/1969 | Ames | 51/392 |
| 3,638,362 | 2/1972 | Stoll | 51/273 |
| 4,062,152 | 12/1977 | Mehrer | 51/273 |
| 4,759,155 | 7/1988 | Shaw | 51/180 |
| 4,779,385 | 10/1988 | Reiter | 51/180 |
| 4,937,984 | 7/1990 | Taranto | 51/273 |

*Primary Examiner*—Robert A. Rose

*Attorney, Agent, or Firm*—Mueller and Smith

[57] ABSTRACT

The present invention is directed to a sanding device which is adapted to substantially confine for collection dust created by the device during its use. The present sanding device comprises a mounting plate having an upper surface, a lower surface, and one or more apertures penetrating therethrough. A hollow tube sealingly is connected to the mounting plate at its proximal end and is connectable to a source of suction at its distal end. A resilient pad, having an upper surface, a lower surface, and side surfaces, is mounted to the lower surface of the plate at its upper surface. The side pad surfaces are sealed. The pad is characterized by being formed from an open weave fiber skeleton exhibiting openings throughout the entire pad structure. The lower surface of the pad defines a substantially smooth plane. A removable apertured sanding sheet (e.g. screen) is mounted to the lower surface of the pad and is supported thereby in a substantially smooth planar configuration. Use of such sanding device to sand substrates in a dustless manner forms another aspect of the present invention.

15 Claims, 2 Drawing Sheets

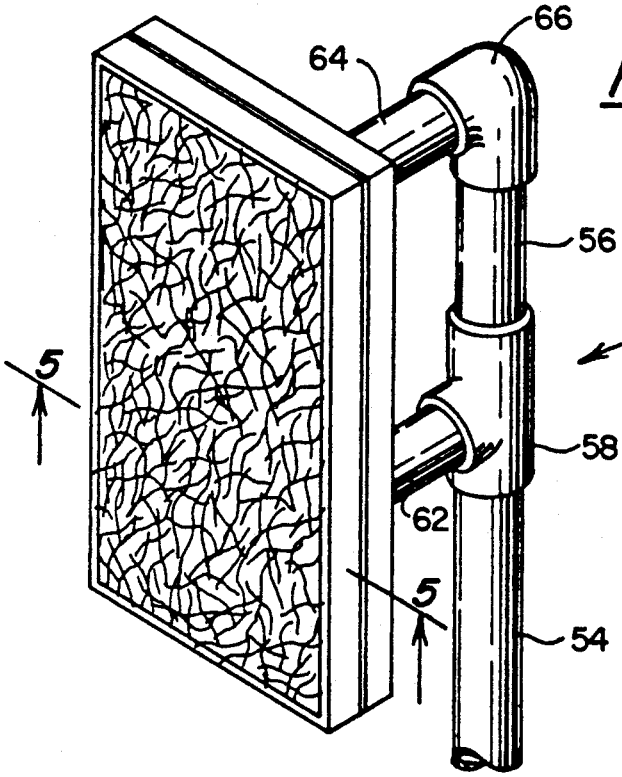
FIG. 4
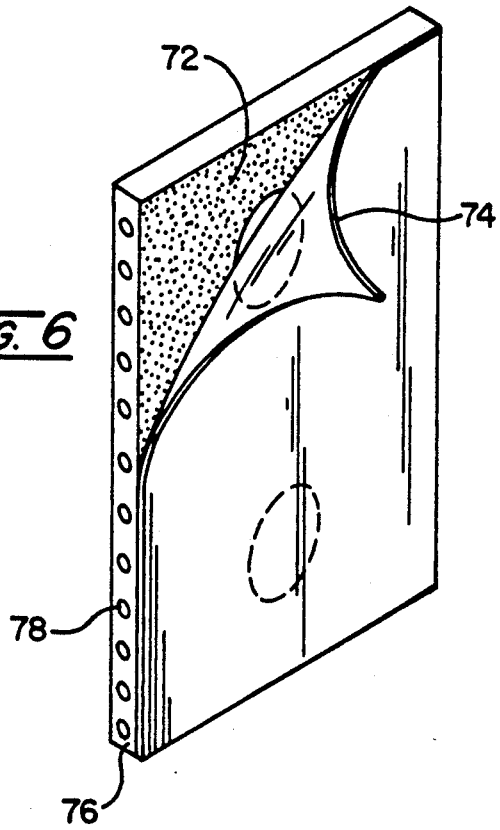
FIG. 6
FIG. 5
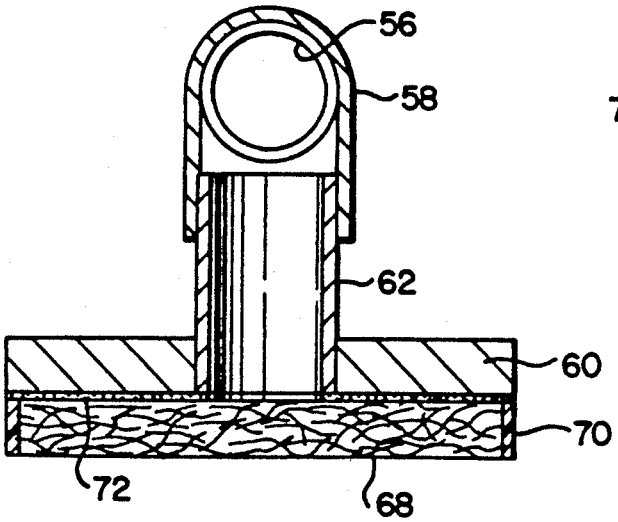

DUSTLESS SANDING DEVICE

BACKGROUND OF THE INVENTION

The present invention relates to sanding devices in general and more particularly to sanding devices that are essentially dustless in use.

In plastering and drywall construction, a smooth finish generally is produced by sanding the surface. In drywall construction, for example, the abutting edges of the plasterboard sheets are covered with a paper or fabric tape and the sheets coated with a layer of plaster material. After the plaster material has dried, it is sanded until a continuous smooth surface results and the abutting edges no longer are discernible. The plastering and drywall construction operations generally are performed near the end of the construction project. Thus, it is important that the fine plaster dust removed by the sander be confined and collected so that the dust is not carried throughout the structure and does not settle on counter tops, walls which need to be painted or wallpapered, carpet or other flooring material, etc. The same concern is more acute when plastering needs to be conducted in the remodeling of an existing structure since furniture, dishes, wall hangings, and the like additionally need to be covered. Even when the room being refinished is sealed from the remaining interior space, the fine airborne dust readily penetrates the confinement and settles out through the remaining interior space.

A variety of techniques have been proposed in the art for connecting a source of suction (e.g. a vacuum cleaner) to the sanding device in order to confine and collect the dust created during the sanding operation. One such proposal found in U.S. Pat. No. 4,697,389 relies on a sand block disposed within the cavity formed by a shroud wherein the remaining annular space within the shroud is connected to a source of suction. In U.S. Pat. No. 4,062,152, an apertured solid plate is connected to a manifold which forms a vacuum chamber by virtue of a source of suction being connected to the chamber. In U.S. Pat. No. 4,759,155, a similar vacuum chamber is fitted with a plate having a pattern of grooves on its outer surface wherein a plurality of regular-occuring apertures are contained within the grooves and provide fluid communication to within the vacuum chamber. A mesh screen, for example, is fitted over the grooved plate and the source of suction engaged for confining the dust created from the sanding operation.

Despite the foregoing and other proposals in the art, no system aimed at substantially eliminating dust during sanding has found success in the marketplace. It is surmised that devices constructed in accordance with the principles employed in the foregoing prior art devices are limited in the fluid communication provided between the source of suction and the sanding screen. A substantial quantity of the dust created during the sanding operation thus is permitted to escape and contaminate the surrounding atmosphere. Thus, there is a long felt need in the carpentry, plastering, and drywall construction art for a dustless sanding device.

BROAD STATEMENT OF THE INVENTION

The present invention is directed to a sanding device which is adapted to substantially confine for collection dust created by the device during its use. The present sanding device comprises a mounting plate having an upper surface, a lower surface, and one or more apertures penetrating therethrough. A hollow tube sealingly is connected to the mounting plate at its proximal end and is connectable to a source of suction at its distal end. A resilient pad, having an upper surface, a lower surface, and side surfaces, is mounted to the lower surface of the plate at its upper surface. The side pad surfaces are sealed. The pad is characterized by being formed from an open weave fiber skeleton exhibiting openings throughout the entire pad structure. The lower surface of the pad defines a substantially smooth plane. A removable apertured sanding sheet (e.g. screen) is mounted to the lower surface of the pad and is supported thereby in a substantially smooth planar configuration. Use of such sanding device to sand substrates in a dustless manner forms another aspect of the present invention.

Advantages of the present invention include its ability to effectively sand surfaces smooth without generating significant air-borne dust created by the sanding operation. The effectiveness of the dust confining ability of the inventive sanding device permits its use without having to cover the furniture and other articles in the vicinity of its use. The effectiveness and efficiency of the inventive sanding device permits a source of suction to even be a home vacuum cleaner. The efficiency in design of the inventive sanding device even permits its adaptation with a long pole so that it can be used to sand ceilings and wall surfaces far out of hand reach. These and other advantages will be readily apparent to those skilled in the art based upon the disclosure contained herein.

BRIEF DESCRIPTION OF THE DRAWINGS

FIG. 4 is a perspective elevational view of a hand-held version of the inventive sanding device;

FIG. 5 is a sectional view taken along line 5—5 of FIG. 4; and

FIG. 6 is a perspective elevational view of a replaceable resilient pad having a self-adhesive surface covered by a removable release sheet.

The drawings will be described in detail in connection with the following description.

DETAILED DESCRIPTION OF THE INVENTION

Prior sander designs aimed at simultaneously vacuuming the created dust all utilize some form of a chamber or header which is attached to a source of suction usually in conjunction with the handle and which has a lower apertured plate which is adapted to be over-fitted with a screen sanding sheet. Insufficient communication between the dust created and the chamber through the apertures appears to be the unifying defect in these prior art designs. Thus, dust does escape the vacuuming system of prior designs, thus resulting in their lack of success in the marketplace. The inventive dustless sanding device overcomes the prior art difficulties in achieving adequate communication between the dust created and the chamber or header by utilizing a pad that functions both as a chamber as well as a support structure for the sanding screen. The unique skeletal structure of the pad has sufficient porosity so that very little pressure drop across it is evident. Concomitant therewith is the ability of the pad to present a lower surface that defines a plane of sufficient structural integrity that it can adequately support the sanding sheet in a substantially planar configuration. Accordingly, the inventive sanding device has been used during home remodeling without the necessity for covering furniture, draperies, carpeting, and like interior objects.

Figure 1:
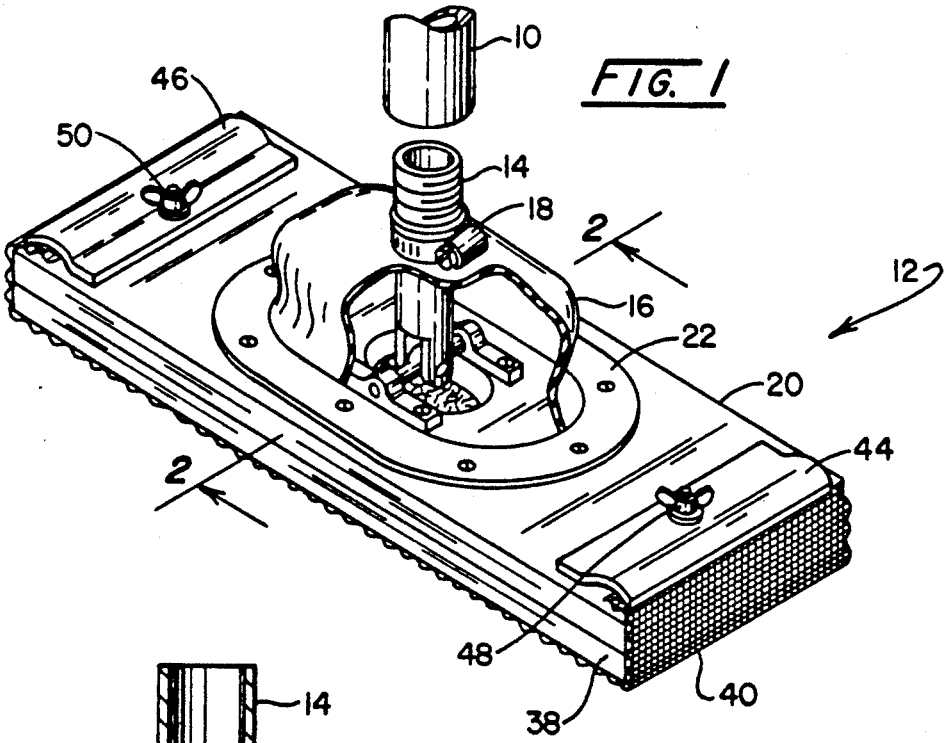
FIG. 1 is a perspective elevational view of the inventive sanding device adapted to be fitted to an extension pole, for example, for use with ceilings and high walls.
Figure 2:
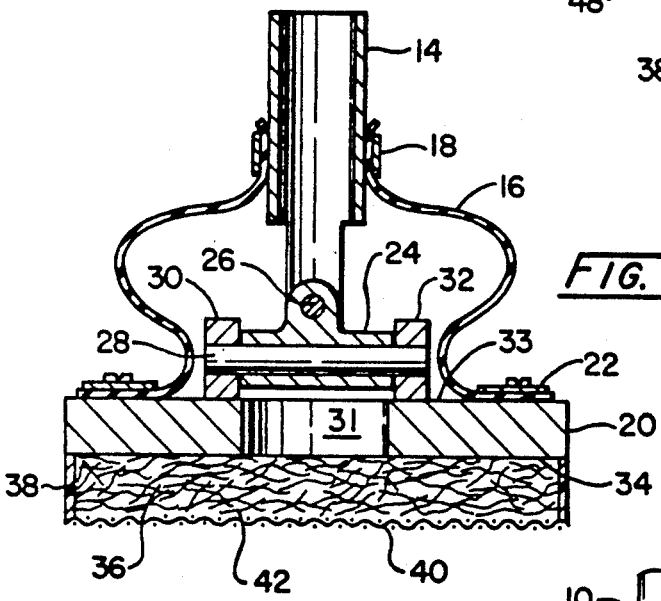
FIG. 2 is a sectional view taken along line 2—2 of FIG. 1.
Figure 3:
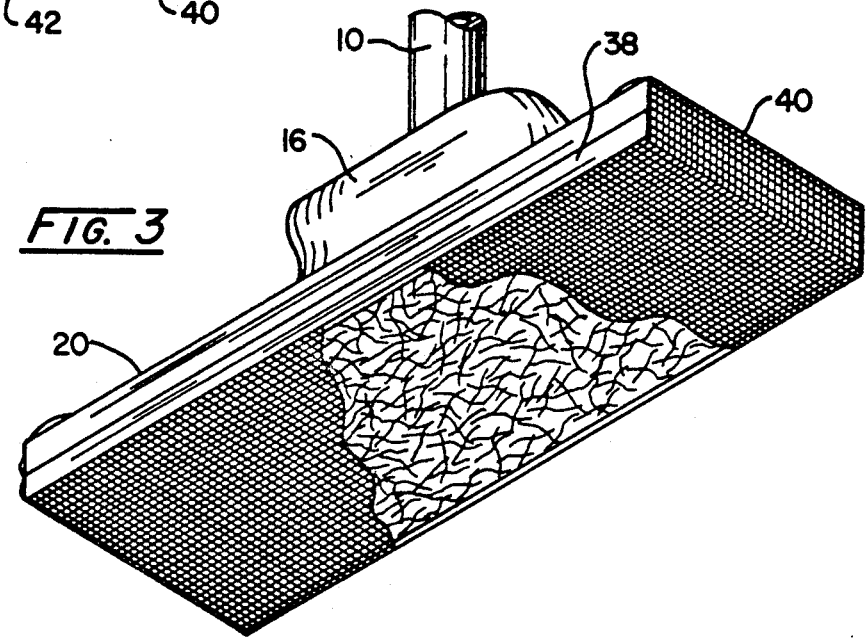
FIG. 3 is another perspective elevational view of the sanding device of FIG. 1 from below with a partial cut-away area revealed.

Referring to the drawings, overhead and underneath perspective elevational views are set forth at FIGS. 1 and 3, while FIG. 2 provides construction details in a cross-sectional elevational view. The embodiment of the sanding device set forth in these figures is manipulated via tubular handle 10 which may be a few feet in length on up to 10 or more feet in length for sanding ceilings and high walls. Tubular handle 10 also is connected to a source of suction, such as a vacuum cleaner or similar device. Connection between tubular handle 10 and inventive sanding device 12 is provided via connector 14 which is threaded at its distal end for screwing into internal threads provided in tubular handle 10. Connector 14 penetrates boot 16 and is secured thereto by clamp 18. Boot 16 is attached to mounting plate 20 by collar 22 which is riveted thereto. A negative pressure should be maintained within boot 16, thus clamp 18 and collar 22 provide an effective air-tight seal to connector 14 and plate 20, respectively. Boot 16 should be made of an elastic material since connector 14 is bi-pivotally attached to mounting plate 20, thus enabling the user of sanding device 12 to manipulate it in use.

As noted above, connector 14 is bi-pivotally connected to plate 20 at its proximal end, as can be seen by reference to FIGS. 1 and 2. Connector 14 is attached to sleeve 24 by pin 26 about which connector 14, and thus handle 10, can pivot. Transverse to pin 26 is pin 28 which is disposed within sleeve 24 and thence at either end through clamps 30 and 32 which each are riveted to plate 20. Pin 28 provides for rotation of sleeve 24 thereabout and, consequently, provides a pivot about which connector 14, and thus handle 10, pivot transverse to the direction of pivot about pin 26. Thus, the bi-pivotal arrangement is accomplished. Other forms of attachment to achieve such degrees of movement can be used as is necessary, desirable, or convenient.

It will be observed that connector 14 is disposed above aperture 31 penetrates through plate 20 and provides communication from tubular handle 10, connector 14, and the cavity created within boot 16 and upper surface 33 of plate 20, to the area about lower surface 34 of plate 20. It will be observed that resilient pad 36 is mounted against lower surface 34 of plate 20. The side surfaces of pad 36 are coated with sealant 38, which can be a caulk (e.g. silicon caulk), tape, polymeric material (e.g. plastic or elastomer), or like material for providing an effective air-tight seal for the side surfaces of pad 36. Finally, sanding screen 40 is seen to be adjacent to and supported by lower surface 42 of pad 36 and is secured to plate 20 via clamps 44 and 46 which are tightened by wing nuts 48 and 50, respectively. It will be appreciated that clamps 44 and 46 could be replaced with spring-biased clamps in conventional fashion.

With respect to pad 36, it will be observed that pad 36 is formed from a three-dimensional skeletal structure which is characterized by an openweave configuration formed from fibers that are bonded at their intersection. The apertures created within pad 36 in the preferred embodiment range from about $\frac{1}{8}$–$\frac{3}{8}$ inches in size and are randomly-dispersed throughout the entire extent of pad 36, though not in a regular arrangement. Accordingly, regardless of which direction is chosen, an effective network of channels is created by the open-weave structure, thus enabling dust created during the sanding operation to readily traverse through the interior of pad 36 to aperture 31 and plate 20 and, thence, through boot 16, connector 14, and handle 10, for eventual collection and disposal. Despite the open weave structure of pad 36, it will be appreciated that the fibers present sufficient rigidity so as to effectively support sanding screen 40 in a uniform, planar configuration for sanding of flat surfaces. Pad 36, also, is resilient, thus enabling it to be slightly compressed and return to its original configuration.

The preferred article for use as pad 36 comprises a non-woven, low-density, flat-surface, open, porous, lofty web of autogenously bonded, continuous, undulating interengaged filaments, such as proposed in U.S. Pat. No. 4,227,350, the disclosure of which is expressly incorporated herein by reference. It will be observed that the '350 patent is intent on making an abrasive product so that abrasive particles coat the liquid resin that binds the undulating interengaged filaments. For making the sanding device of the present invention, however, such abrasive particles are unnecessary and preferably should be avoided since the pad functions as a supporting member for screen 40. The degree of openness and loftiness evidenced by the abrasive pad in the '350 patent is evidenced by a void volume of greater than 80%, preferably 85%–97%, in uncoated state with the coated product still retaining a high void volume. The filament diameter preferably is about 5–125 mils and preferably is about 10–20 mils. The pad is stated to have a tensile strength of at least about 3,000 psi with an ultimate elongation of greater than 180%. Thus, it will be observed that the highly open and porous pad provides good structural support for the sanding screen, yet has a sufficiently high porosity or void volume that it permits highly efficient collection of dust created during the sanding operation. Other similarly-constituted pads may function efficaciously in accordance with the precepts of the present invention providing that the degree of structural support and void volume is maintained.

In FIGS. 4–5, a hand-held version of the inventive sanding device is set forth. It will be observed that handle 52 is tubular and consists of pipes 54 and 56 which are connected via tee 58 for providing a handle for grasping of the device by its user. In this hand-held configuration, plate 60 has two apertures through which are fitted pipe sections 62 and 64. Pipe 62 is connected to tee 58 while pipe 64 is connected to elbow 66 which also is connected to pipe 56. It will be appreciated that more or fewer holes could be utilized within plate 60 or plate 20 with respect to the pole sanding embodiment of the present invention. Also, handle 52 can be envisioned as a singular tubular member.

On the underside of plate 60 is disposed pad 68 which has its sides sealed by sealant 70. It will be observed that pad 68 is attached to plate 60 via adhesive layer 72. With reference to FIG. 6, it will be observed that pad 68 with adhesive layer 72 has release sheet 74 covering adhesive layer 72. Such an arrangement permits ready replacement of pads when they wear out. Also, it will be appreciated that when sanding in corners, workers often desire the sanding device to sand both surfaces forming the corner. Screens normally are oversized and wrap around all four edges of conventional sanding devices, which is an appropriate configuration for the inventive sanding device additionally. In this regard, the screen can wrap around side surface 76 (see FIG. 6) as a series of apertures, e.g. aperture 78, which provide communication to within pad 68 for collecting dust created during sanding of corners. Alternatively, a thicker pad can be used for facilitating the bottom and a side both to support the screen for sanding in corners.

It should be understood that sealant 70 may not be needed if mounting plate 60 has downwardly-projecting side-walls within which pad 68 can be fitted. In such instance, apertures then would be formed within such sidewalls.

As to materials of construction, desirably all materials are plastic for minimizing the weight of the inventive sanding device though metal, ceramic, or other material could be used as is necessary, desirable, or convenient. Sanding screen 40 preferably is a conventional metal screen for sanding of plaster or the like, though it too could be manufactured from plastic or another material.

Since certain changes may be made in the above invention without departing from the scope of the invention herein involved, it is intended that all matter contained in the above description or shown in the accompanying drawings shall be interpreted as illustrative and not in a limiting sense. All citations herein are expressly incorporated by reference.

I claim:

1. In a sanding device adapted to substantially confine for collection dust created by said device in use, said sanding device comprising:

a mounting plate having an upper surface, a lower surface, and an aperture penetrating therethrough;

a hollow connector sealingly connected to said mounting plate aperture at its proximal end and connectable to a source of suction at its distal end; and a removable apertured sanding sheet having an upper surface and a lower surface;

the improvement which comprises:

a porous resilient pad mounted between said mounting plate and said sanding sheet, said pad having an upper surface, a lower surface, and side surfaces, its upper surface being mounted to said plate lower surface, its lower surface defining a plane and being mounted to and supporting said sanding sheet upper surface, its side surfaces being sealed, said pad characterized by an open, porous, low density fiber skeleton exhibiting openings throughout the entire pad, whereby essentially all dust created by said sanding device is communicated through said pad for confinement and collection.

2. The sanding device of claim 1 wherein said pad is formed from autogenously bonded, continuous, undulating, interengaged filaments having a diameter ranging from between about 5 and 125 mils.

3. The sanding device of claim 1 wherein said sanding sheet comprises a screen.

4. The sanding device of claim 1 wherein a flexible boot sealingly connects said hollow connector to said mounting plate.

5. The sanding device of claim 1 wherein an elongate hollow pole attaches to said hollow connector at one end and to a source of suction at its other end.

6. The sanding device of claim 1 wherein said hollow connector is pivotally attached to said mounting plate.

7. The sanding device of claim 1 wherein apertures penetrate through at least one of said side sealed surfaces.

8. In a method for sanding a substrate and collecting the dust created thereby which comprises:

sanding said substrate with a sanding device which comprises:

a mounting plate having an upper surface, a lower surface, and an aperture penetrating therethrough;

a hollow connector sealingly connected to said mounting plate aperture at its proximal end and connected to a source of suction at its distal end; and a removable apertured sanding sheet having an upper surface and a lower surface;

the improvement wherein said sanding device additionally comprises:

a porous resilient pad mounted between said mounting plate and said sanding sheet, said pad having an upper surface, a lower surface, and side surfaces, its upper surface being mounted to said plate lower surface, its lower surface defining a plane and being mounted to and supporting said sanding sheet upper surface, its side surfaces being sealed, said pad characterized by an open, porous, low density fiber skeleton exhibiting openings throughout the entire pad; and engaging said source of suction during said sanding, whereby essentially all dust created by said sanding device is communicated through said porous resilient pad for confinement and collection.

9. The method of claim 8 wherein said pad is formed from autogenously bonded, continuous, undulating, interengaged filaments having a diameter ranging from between about 5 and 125 mils.

10. The method of claim 8 wherein said sanding sheet comprises a screen.

11. The method of claim 8 wherein a flexible boot sealingly connects said hollow connector to said mounting plate.

12. The method of claim 8 wherein an elongate hollow pole attaches to said hollow connector at one end and to a source of suction at its other end.

13. The method of claim 8 wherein said hollow connector is pivotally attached to said mounting plate.

14. The method of claim 8 wherein apertures penetrate through at least one of said side sealed surfaces.

15. The method of claim 8 wherein said source of suction comprises a vacuum cleaner.

* * * * *